United States Patent [19]

Wies

[11] Patent Number: 4,991,845

[45] Date of Patent: Feb. 12, 1991

[54] FLIPPER GAME

[76] Inventor: Wolfgang Wies, Goettinger Strasse 5, 6090 Ruesselsheim, Fed. Rep. of Germany

[21] Appl. No.: 366,488

[22] Filed: Jun. 15, 1989

[51] Int. Cl.[5] ..... A63F 7/00; H03K 17/00

[52] U.S. Cl. ..... 273/121 A; 361/179; 273/123 R; 273/118 R

[58] Field of Search ..... 273/121 A, 11 C, 11 R; 361/179, 180

[56] References Cited

U.S. PATENT DOCUMENTS

| | | | |
|---|---|---|---|
| 2,192,596 | 3/1940 | Durant | 273/121 A |
| 2,610,059 | 9/1952 | Koci | 273/121 A |
| 3,629,678 | 12/1971 | Tyler | 361/179 |
| 3,675,927 | 6/1972 | Gottlieb | 273/119 A |
| 4,176,844 | 12/1979 | Ryan et al. | 273/121 A |
| 4,542,905 | 9/1985 | Hooker | 273/121 A |
| 4,663,542 | 5/1987 | Buck et al. | 361/180 |
| 4,757,213 | 6/1988 | Tigges et al. | 361/179 |

*Primary Examiner*—Randall L. Green
*Assistant Examiner*—Gary Jackson
*Attorney, Agent, or Firm*—Gifford, Groh, Sprinkle, Patmore and Anderson

[57] ABSTRACT

A flipper game apparatus comprises an inclined playing surface on which are disposed switches adapted to be operated by balls rolling over the playing surface and encountering the switches. A ball is introduced on to the playing surface by a respective player and rolls down the playing surface towards the outlets, passing the striker switches as they do so. The outlets are flanked by flippers which can be actuated by a respective player. So that two players can play at the same time and in mutual interreaction, the game uses balls of first and second different types, while operatively associated with at least some switches is a sensor which is responsive only to one type of ball. A circuit distinguishes the types of balls from each other upon actuation of a switch, by means of the respective sensors.

13 Claims, 2 Drawing Sheets

FLIPPER GAME

BACKGROUND OF THE INVENTION

The invention relates to an apparatus for playing a game known as a flipper game.

A flipper game apparatus comprises a playing area in the form of a generally flat surface which is slightly inclined relative to the horizontal towards one end of the surface at which the player stands. The apparatus has a generally spring-loaded device for introducing balls on to the playing area, at a controllable speed. The balls are thus shot on to the playing area at the end remote from the player, which end is at a higher level than the end towards the player, so that the balls then tend to roll back down the playing area towards the player and thus also towards an outlet which is disposed at the lower end of the playing area. Arranged on the playing area are a number of obstacles of different kinds, which either only guide the ball as it rolls across the playing area, in a given direction, or which may have a resilient reflection effect so as to shoot the ball away in a different direction. When certain obstacles are encountered by the ball in the course of its rolling movement, points are credited to the player's total or subtracted therefrom, and the running total of points held by the player is stored in a total counter. Arranged in the region of the outlet are a pair of pivotally mounted members which are referred to as flippers. The player has buttons which he can press to actuate the flippers which are caused to pivot about their pivot mountings with a fairly violent movement, by way of solenoid coils. In that way the flippers can shoot the ball back on to the playing area, thus preventing it from reaching the outlet. Such an apparatus can only be used by a single player at a time, and competition between players can only take place by comparing the points totals that each player accumulates in a given period of playing on the apparatus.

SUMMARY OF THE INVENTION

An object of the present invention is to provide a flipper game apparatus in which first and second players can play simultaneously and in such a way as to be in mutual reaction with each other.

Another object of the present invention is to provide a flipper game apparatus which affords enhanced possibilities in regard to winning points when playing the game.

Still another object of the present invention is to provide a flipper game apparatus which can provide a wider range of possible variations in the way in which the game is played thereon.

In accordance with the present invention, those and other objects are achieved by a flipper game apparatus comprising a playing surface which in use of the game is slightly inclined with respect to the horizontal, towards a lower end of the playing surface, at which the user of the apparatus generally stands. The playing surface has at least one outlet in the region of its lower end, while disposed on the playing surface are striker switches which can be hit by a ball which is introduced on to the playing surface as the ball rolls towards the lower end thereof. Disposed in flanking relationship to the at least one outlet is a pair of flippers adapted to be operated by the player using the apparatus. The balls used in the apparatus constitute first and second different types, while associated with at least some of the striker switch means is a sensor which is responsive only to one type of ball. The apparatus further includes a circuit which upon actuation of a said striker, switch means, distinguishes the types of balls from each other, by means of the sensor.

Thus, in use of the flipper game apparatus according to the invention, different types of balls are associated with each of first and second players. When the respective balls strike against the respective striker switch means which are provided with a sensor as referred to above, a distinction can be made between the respective types of balls, by virtue of the sensor being responsive only to one type of ball. The points which are thus gained by virtue of the balls striking the various obstacles and striker switch means thereof can thus be attributed separately to the respective players. The players can attempt to impede the ball being used by the respective other player, for example by means of skilled actuation of the player's flippers. In a similar manner, each player can operate his flippers to return his own ball back on to the playing surface, but can refrain from operating his flippers when it is the ball of the other player that is rolling towards the outlet over which the first-mentioned player has control.

Although the foregoing paragraph refers to the flipper game apparatus being used by first and second players, it will be appreciated that it can also be used by only one player at a time, who can then play with two different types of balls, to enhance the variation in the game and to increase its attraction.

It should be noted at this point that, when reference is made hereinbefore and also hereinafter to striker switch means, that term does not only mean switch means against which a ball strikes to cause actuation of the switch means, but also roll-over switch means which are actuated by a ball as it rolls over the switch means.

In accordance with a preferred feature of the invention, first and second separate counters for counting the points gained by means of the first and second types of balls may be provided in the region of the respective outlets. The counters may advantageously each have a respective striker switch means with a sensor which is responsive only to the one type of ball in order to be able to distinguish between them.

In another feature of the invention the sensor may be a proximity switch which is responsive to a given type of ball. Such proximity switches may be used in many different alternative forms, for example operating on an optical, electrical or magnetic basis.

In another feature of the invention the balls of one type may comprise a non-metallic material, the balls of the other type may comprise a metallic material, and the sensor may be operable to produce an electrical and/or magnetic field which, upon the approach of a ball of said other type, is disturbed by the metallic material thereof. In another form of the arrangement the balls of said other type may include ferromagnetic material and the sensor may include a magnetic coil and a Hall generator which is so arranged in the magnetic field of the coil that the Hall generator produces a signal when the magnetic field is disturbed. Those signals are then passed to the counting means for counting up the points won by the respective players.

A preferred feature of the invention provides that the apparatus has an input means for introducing each respective type of ball, and first and second outlets, each having a respective pair of flippers. Each player can thus operate his own respective ball-input means and a respective pair of flippers. In that case the players can introduce balls on to the playing surface separately from each other and can also actuate the pairs of flippers independently of each other.

So that the balls of the first and second types can be distinguished from each other, by the players when they are rolling over the playing surface, they are advantageously of a different visual aspect, being for example of different colours or having different levels of reflectivity. So that the balls behave in the same manner in regard to mechanical characteristics, as when rolling over the playing surface or when encountering obstacles and striker switch means, the balls of the first and second types are desirably of the same diameters and weights. In that connection there, are many possible ways in which the balls of the different types may be made. Thus the apparatus may be used to play a game with balls made from plastic material, ceramic material or wood, of different colours, in which one type of ball contains a ferromagnetic metal core and the other type of ball contains a non-magnetic metal core, consisting for example of brass. It is also possible to use glass balls with different cores or metal balls on the one hand and balls of plastic material, glass or ceramic material on the other hand. If the weight of each ball is to be the same, with the ball also being of the same diameter, the weights of the balls may be made equal to each other by the balls of plastic material, glass or ceramic material including for example a filling of heavy metal, to raise the weight thereof to the already high weight of the other balls which are made of metal. It is also possible to use steel or plastic balls which consist of the same material for the two types of balls; in that case, when the balls are made of steel, the difference between the first and second types thereof may lie only in magnetisation of one type of ball or in different forms of magnetisation of the first and second types of balls while when the balls are of plastic material, the difference between the first and second types thereof may lie in correspondingly different electrical polarisation thereof (electret material being used in that case).

Although reference is made hereinbefore to the game being played by first and second players, it should be appreciated that the flipper game apparatus according to the invention may also be so designed that it can be played by more than two players, for example by using a multiplicity of different balls, together with sensors which are capable of suitably distinguishing therebetween.

Further objects, features and advantages of the invention will be apparent from the following description of a preferred embodiment thereof.

DESCRIPTION OF THE PREFERRED EMBODIMENT

Figure 1:
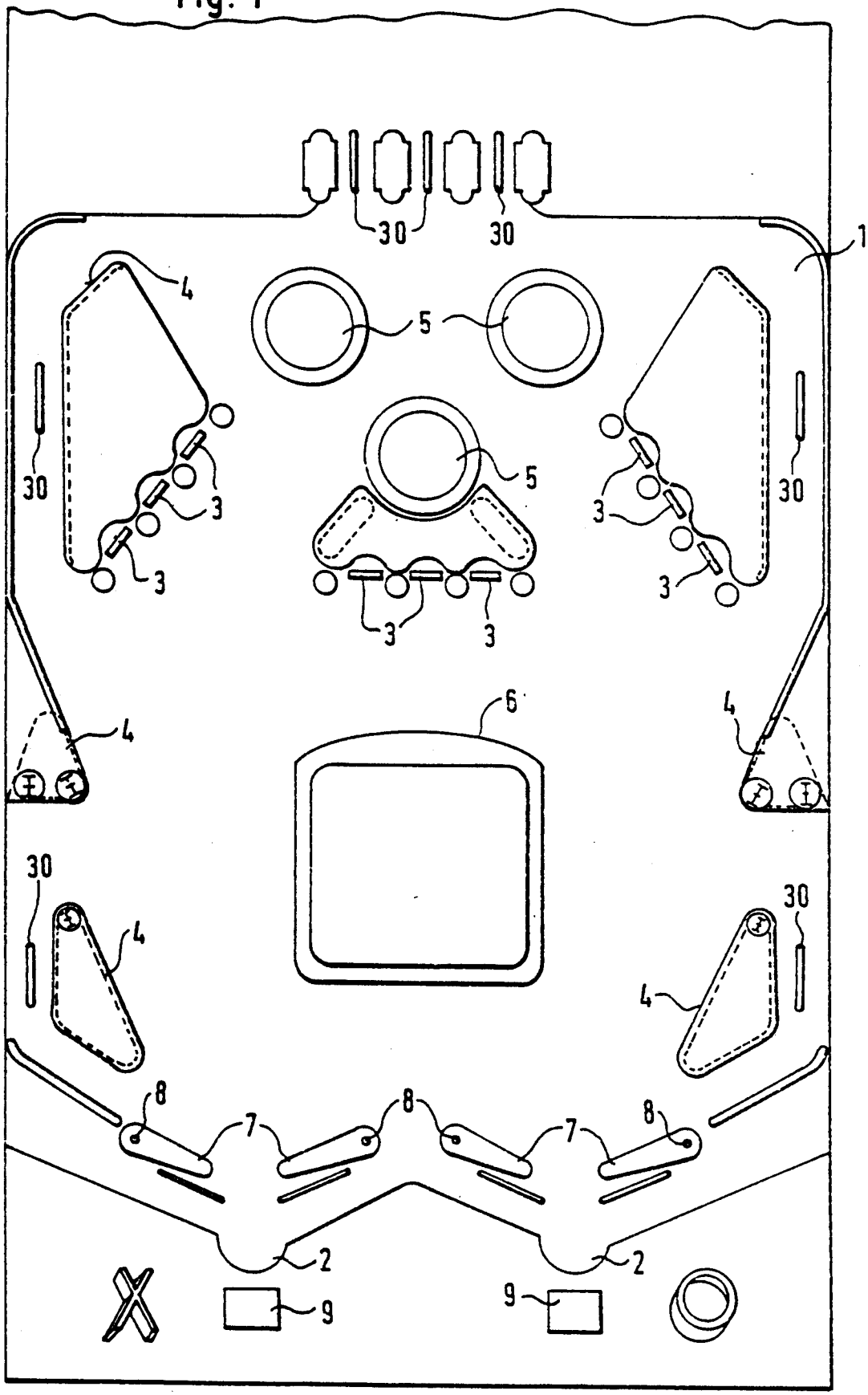
FIG. 1 is a diagrammatic plan view of the playing surface of a flipper game apparatus in accordance with the invention.

Referring firstly to FIG. 1, shown therein is a plan view on to a flipper game apparatus in accordance with the present invention, illustrating the playing area or surface thereof, as shown at reference numeral 1. The playing surface 1 is slightly inclined relative to the horizontal in such a way that the end which is at the top in FIG. 1 is higher than the other end of the playing surface 1, which is shown at the bottom in FIG. 1.

The apparatus comprises first and second separate input devices (not shown) for shooting first and second types of balls on to the playing surface, whereupon each ball will tend to roll towards the lower end, at the bottom in FIG. 1, by virtue of the inclined positioning of the playing surface 1. Each of first and second players thus operates his own input means and can shoot a ball of the type with which he is playing, or a plurality of such balls, successively on to the higher part of the playing area. When the balls have been put on to the playing area in that way, they then roll downwardly towards the lower end as shown in FIG. 1, by passing over roll-over switches as indicated at 30 towards the upper end of the playing surface 1, causing the switches 30 to be actuated as the balls roll thereover.

First and second outlets as indicated at 2 towards the bottom of FIG. 1 are provided for the balls which under the influence of the force of gravity roll downwardly over the playing surface 1.

Arranged on the playing surface 1 are a plurality of obstacles for the balls. The obstacles may be such that, upon being encountered by a ball, the obstacle only guides the ball in a given direction, or it may include operating means which cause the ball to be resiliently shot away in some other direction. The obstacles have striker switches as indicated at 3 which may also be in the form of striker or contact surfaces as indicated at other locations by reference numeral 4. Mushroom-like obstacles 5 permit the balls to be shot actively away in various directions.

Reference numeral 6 in FIG. 1 identifies a display area at the centre of the playing surface 1, for displaying the results of a game. Reference numeral 30 denotes further roll-over switches which are disposed along the lines of travel along which the balls may roll.

Arranged in front of the respective outlets 2 are members which are referred to as flippers, being in the form of pivotally mounted pairs of lever arms which can be pivoted about their pivot axes as indicated at 8 by actuation of magnetic coils or solenoids. When a player actuates his flippers 7, a ball in the operating region of the respective flippers may be shot back towards the upper end of the playing surface 1. If the flippers 7 are not actuated in that way, a ball can roll between them towards the outlet 2.

Disposed behind the outlets are respective counters 9 which are capable of distinguishing between the outgoing balls of the first and second types.

Figure 2:
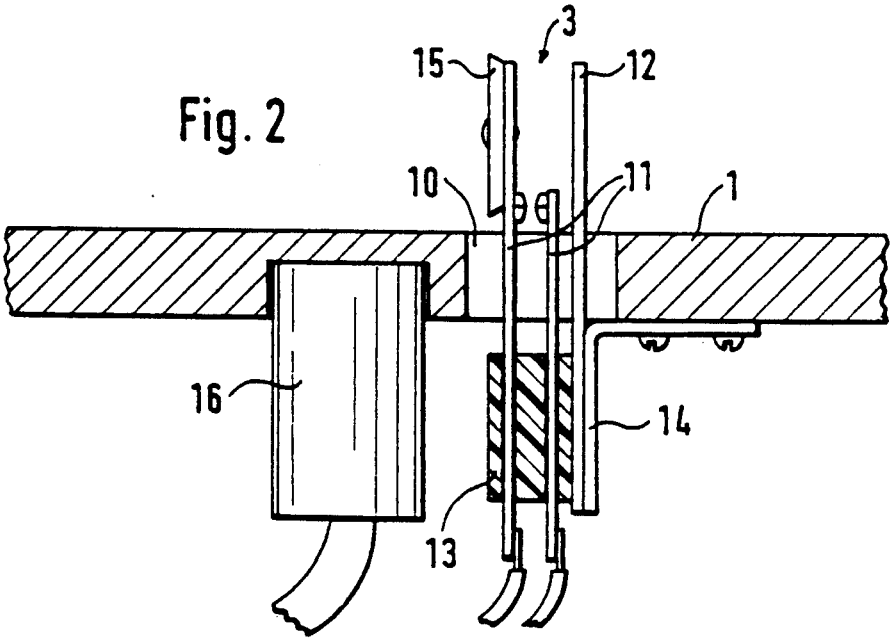
FIG. 2 is a side view of a striker switch means with associated sensor, arranged on the playing surface.

Reference will now be made to FIG. 2 which is a side view in section of one of the striker switches 3 which is arranged to project through an opening 10 in the playing surface 1. The switch 3 comprises first and second contact tongues or blades 11 which carry the usual contact studs and which are secured in position beneath the playing surface 1, together with a stop member 12, by means of an insulating block 13 and an angle member 14. The contact tongue or blade 11 which is on the left in FIG. 2 carries a striker plate 15 which, when hit by a ball (not shown), causes the left-hand contact tongue or blade 11 to come into contact with the other contact tongue or blade 11 so that the contact studs thereon come into contact with each other, thereby to close the switch 3.

A proximity switch 16 is disposed in a recess in the underside of the playing surface 1, in front of the striker plate 15 in the direction of movement of a ball as it moves towards the striker plate 15. The proximity switch 16 may be any commercially available kind of proximity switch which is designed to be responsive to balls of a given type. For example the proximity switch 16 may include a coil which is part of a transistor oscillator which oscillates at comparatively high frequency. If the coil in the proximity switch 16 is damped by a ball which passes into the magnetic field generated by the coil, the oscillation breaks down and a signal is produced. The signal, together with the contact signal produced by closure of the striker switch 3, provides for recognition of the corresponding type of ball, by logic processing, in a circuit arrangement which is suitably connected to the striker switch 3. If therefore the two signals from the proximity switch 16 and the striker switch 3 occur in quick succession, that indicates that the ball which has hit the striker plate 15 to close the striker switch 3 after passing over the operating area of the proximity switch 16 is a ball of the one type, while if it is only the signal from the striker switch 3 that is produced, then that indicates that the ball that has hit the striker plate 15 is a ball of the other type.

The roll-over switches 30 shown in FIG. 1 are of a fully similar design configuration to the striker switches 3 and will thus be operated in the same manner. In that case however the contact tongues or blades of a roll-over switch 30 are not actuated by a ball striking against a striker plate 15 as shown in FIG. 2, but by the ball rolling over a loop member (not shown) which is thus operable to cause closure of the switch 30. Each switch 30 may also have a proximity switch as shown at 16 in FIG. 2, in association therewith, in order thereby to distinguish between the first and second types of balls.

Figure 3:
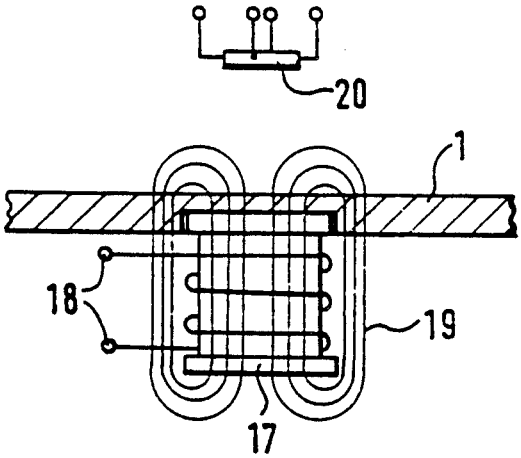
FIG. 3 shows a sensor formed from a magnetic coil and a Hall generator.
Figure 4:
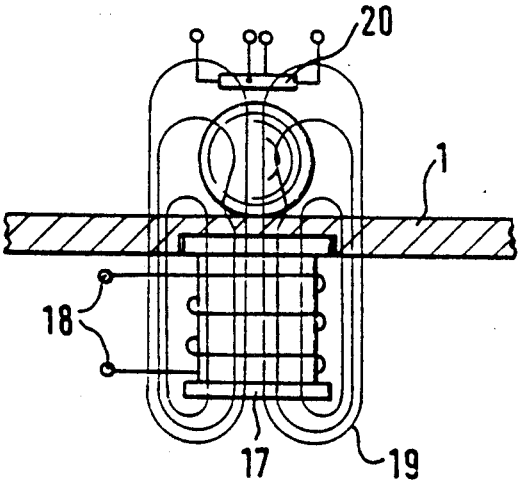
FIG. 4 shows the sensor of FIG. 3 in the condition which occurs when a ball rolls through that arrangement.

Reference will now be made to FIGS. 3 and 4 showing another possible construction for recognising the respective types of balls. As shown in FIGS. 3 and 4, disposed beneath the playing surface 1 is a magnetic coil 17 which, when supplied with a direct or alternating current to the terminals 18 thereof, generates a magnetic field which is indicated by the lines of force 19. Disposed above the playing surface 1 and at a spacing therefrom is a Hall generator 20 of conventional kind which has four terminals for the supply of a current which flows through the generator, and for taking off the Hall voltage generated thereby.

In the situation shown in FIG. 3, the magnetic field, with its lines of force 19, does not in practice reach the Hall generator 20 so that no Hall voltage is produced. If however as shown in FIG. 4, a ball rolls between the coil 17 and the Hall generator 20, then, if the ball contains ferromagnetic material, the magnetic field represented by the lines of force 19 is disturbed and the lines of force 19 now reach the Hall generator 20 which then supplies a Hall voltage, as a display signal.

Sensors of the kind shown in FIGS. 3 and 4 may be used for example as the counters 9 behind the respective outlets 2. However they may also be used within the playing surface in order to show that a ball has rolled past that respective location.

As indicated above, the balls of the first and second types will generally be of the same diameter and the same weight, but will be visually distinguishable so that the respective players can identify their own balls and thus also the balls being used by their opponents. For that purpose the balls may have different colours, different surface patterns, or may produce for example light-reflecting effects. In that way first and second players, or more than two players, may play on the apparatus at the same time and in actual intereaction so that each player has the option of modifying his game to deal with movements of the balls produced by his opponent, thus making the game a dynamic procedure, rather than each player playing in isolation and separately from his opponent.

It will be appreciated that the above-described flipper game apparatus according to the invention has been set forth solely by way of example and illustration of the principles of the invention and that various modifications and alterations may be made therein without thereby departing from the spirit and scope of the invention.

I claim:

1. A flipper game apparatus for playing by a multitude of players comprising balls of first and second different types, a playing surface having first and second ends, means for introducing balls on to the playing surface for the balls to roll thereover, a multiplicity of outlets located adjacent at one of said ends for said balls which have rolled over said playing surface, a plurality of switch means each adapted to be actuated by a ball encountering same as it rolls over said playing surface, a plurality of flippers flanking said outlets, means adapted to be operated by a player for actuating said flippers, a respective sensor means operatively associated with at least some of said switch means and responsive only to one type of ball, and a circuit adapted upon actuation of said switch means to distinguish the types of ball from each other by means of said sensor means.

2. A game as set forth in claim 1 and further including first and second separate counters for each of said first and second types of ball, said counters being disposed in the region of said outlets.

3. A game as set forth in claim 2 wherein each said counter has a respective switch means adapted to be actuated by a ball encountering the same said sensor means responsive only to said one type of ball.

4. A game as set forth in claim 1 wherein each said sensor means is a proximity switch responsive to said one type of ball.

5. A game as set forth in claim 4 wherein said proximity switch is arranged beneath said playing surface.

6. A game as set forth in claim 1 wherein the balls of said one type comprise metallic material, the balls of the other type include non-metallic material, and each said sensor means is operable to produce a field which is disturbed by the metallic material of ball of said one type as said ball approaches said sensor means.

7. A game as set forth in claim 6 wherein said field is an electrical field.

8. A game as set forth in claim 6 wherein said field is a magnetic field.

9. A game as set forth in claim 6 wherein the balls of said one type include ferromagnetic material and each said sensor means includes a magnetic coil and a Hall generator so arranged in the magnetic field produced by said magnetic coil that the Hall generator produces a signal when said magnetic field is disturbed.

10. A game as set forth in claim 1 and including a respective input means for introducing each said type of ball, said playing surface fixed during play, and having a first end and a second end; and first and second outlets, each said outlet having a respective pair of said flippers, with respective means for operation of said input means and said pair of flippers by a respective player.

11. A game as set forth in claim 1 wherein the balls of said first and second types are of at least substantially the same diameter and at least substantially the same weight.

12. A game as set forth in claim 1 wherein the balls of said first and second types are adapted to produce a different light-reflecting effect.

13. A flipper game apparatus comprising: a playing surface fixed during play and having a first end and a second end, the playing surface sloping in such a way that said first end is at a higher level than said second end in the position of the apparatus for playing the game; a plurality of balls constituting first and second different types; first and second means for introducing the balls on to the playing surface at least adjacent said first end thereof, whereby said balls roll towards said second end of said playing surface: means operable by respective players for actuating said first and second means for introducing said balls; a plurality of switch means adapted to be actuated by a ball encountering same in the course of its rolling movement over said playing surface; first and second outlets for the balls disposed at least adjacent said second end of said playing surface, for receiving a ball which has rolled down said playing surface towards said second end thereof; a respective pair of flipper members flanking each said outlet; means adapted to be operated by a respective player for actuating a respective pair of said flippers; a sensor responsive only to one type of ball, operatively associated with at least some of said switch means; and a circuit operatively connected to said switch means and said sensors and adapted, upon actuation of a said switch means by a said ball, to distinguish the balls of one type from balls of the other type by means of the response on the part of said sensors.

* * * * *